US005979476A

United States Patent [19]

Cranny

[11] Patent Number: 5,979,476

[45] Date of Patent: Nov. 9, 1999

[54] FOLDING WALKER WITH MULTIPLE CONFIGURATIONS

[76] Inventor: Charles J. Cranny, 168 Gage, Riverside, Ill. 60546

[21] Appl. No.: 09/089,437

[22] Filed: Jun. 3, 1998

Related U.S. Application Data

[63] Continuation-in-part of application No. 08/780,688, Jan. 8, 1997, abandoned

[60] Provisional application No. 60/009,640, Jan. 11, 1996.

[51] Int. Cl.[6] ..... A61H 3/00

[52] U.S. Cl. ..... 135/67; 24/279; 24/336; 135/74

[58] Field of Search ..... 135/67, 74; 52/713; 292/256.67, 256.65; 24/279, 282, 336

[56] References Cited

U.S. PATENT DOCUMENTS

| | | |
|---|---|---|
| 4,196,742 | 4/1980 | Owen, Jr. . |
| 4,373,235 | 2/1983 | Korgaonkar . |
| 4,391,317 | 7/1983 | Savage . |
| 4,669,156 | 6/1987 | Guido et al. . |
| 4,748,994 | 6/1988 | Schultz et al. . |
| 4,907,794 | 3/1990 | Rose . |
| 5,188,139 | 2/1993 | Garelick . |
| 5,201,333 | 4/1993 | Shalmon et al. . |
| 5,226,274 | 7/1993 | Sommerstein . |
| 5,347,781 | 9/1994 | Hanlon . |
| 5,433,235 | 7/1995 | Miric et al. . |
| 5,669,590 | 9/1997 | Przewodek . |

OTHER PUBLICATIONS

Guardian, *Grace's Walker User Instructions*, by Sunrise Medical, 1991.

Sammons Preston, *The Preferred Source of Rehabilitation Professionals*, by Sammons Preston, p. 153, 1998.

*Primary Examiner*—Beth Aubrey

*Attorney, Agent, or Firm*—Arnold White & Durkee

[57] ABSTRACT

A folding walker includes a pair of side frames each of which includes front and rear legs spaced from each other and held together by upper and lower connecting members. At least one lateral cross bar connects the front legs of the side frames, and the connections between the cross bar and the side frames is pivotable to permit the side frames to be pivoted from open positions in which the side frames are substantially perpendicular to the lateral brace and collapsed positions in which the side frames are substantially parallel to the cross bar. Latches hold the side frames in the open positions or in an intermediate position, between the open and collapsed positions, in which the side frames are at an acute angle to the cross bar so that the side frames and the cross bar form a generally triangular configuration to facilitate use of the walker on stairs.

14 Claims, 4 Drawing Sheets

FOLDING WALKER WITH MULTIPLE CONFIGURATIONS

CROSS REFERENCES RELATED APPLICATIONS

This is a continuation-in-part of U.S. patent application Ser. No. 08/780,688, filed Jan. 8, 1997, now abandoned; which in turn is a complete application claiming the benefit of Provisional Patent Application Ser. No. 60/009,640, filed Jan. 11, 1996.

FIELD OF THE INVENTION

The field of the invention is stabilizers for walkers. Specifically, the invention relates to stabilizers for walkers which allow an invalid to easily and safely ascend and descend a staircase using a walker.

SUMMARY OF THE INVENTION

It is a primary object of the invention to provide a stabilized walker allowing safe and assistance-free ascending and descending of stairs for invalids or other walker users.

It is a further object of the present invention to provide a stabilizer that does not interfere with the operation of the walker when the stabilizer is not in use.

It is another object of the invention to provide a stabilizer that is easy to use without the need for detailed, printed instructions.

It is another object of the invention to provide a stabilizer that is simple and cost-effective to manufacture.

Other aspects and advantages of the present invention will become apparent upon reading the following detailed description and in reference to the drawings.

In accordance with the present invention, the foregoing objectives are realized by providing a folding walker comprising a first side frame including front and rear legs spaced from each other and held together by upper and lower connecting members, a second side frame including front and rear legs spaced from each other and held together by upper and lower connecting members, at least one lateral cross bar connecting the front legs of the first and second side frames, the connections between the cross bar and the side frames being pivotable to permit the side frames to be pivoted from open positions in which the side frames are substantially perpendicular to the lateral brace and collapsed positions in which the side frames are substantially parallel to the cross bar, first latching means for holding the side frames in the open positions, and second latching means for holding the side frames in an intermediate position, between the open and collapsed positions, in which the side frames are at an acute angle to the cross bar so that the side frames and the cross bar form a generally triangular configuration to facilitate use of the walker on stairs.

DETAILED DESCRIPTION OF THE PREFERRED EMBODIMENTS

Figure 1:
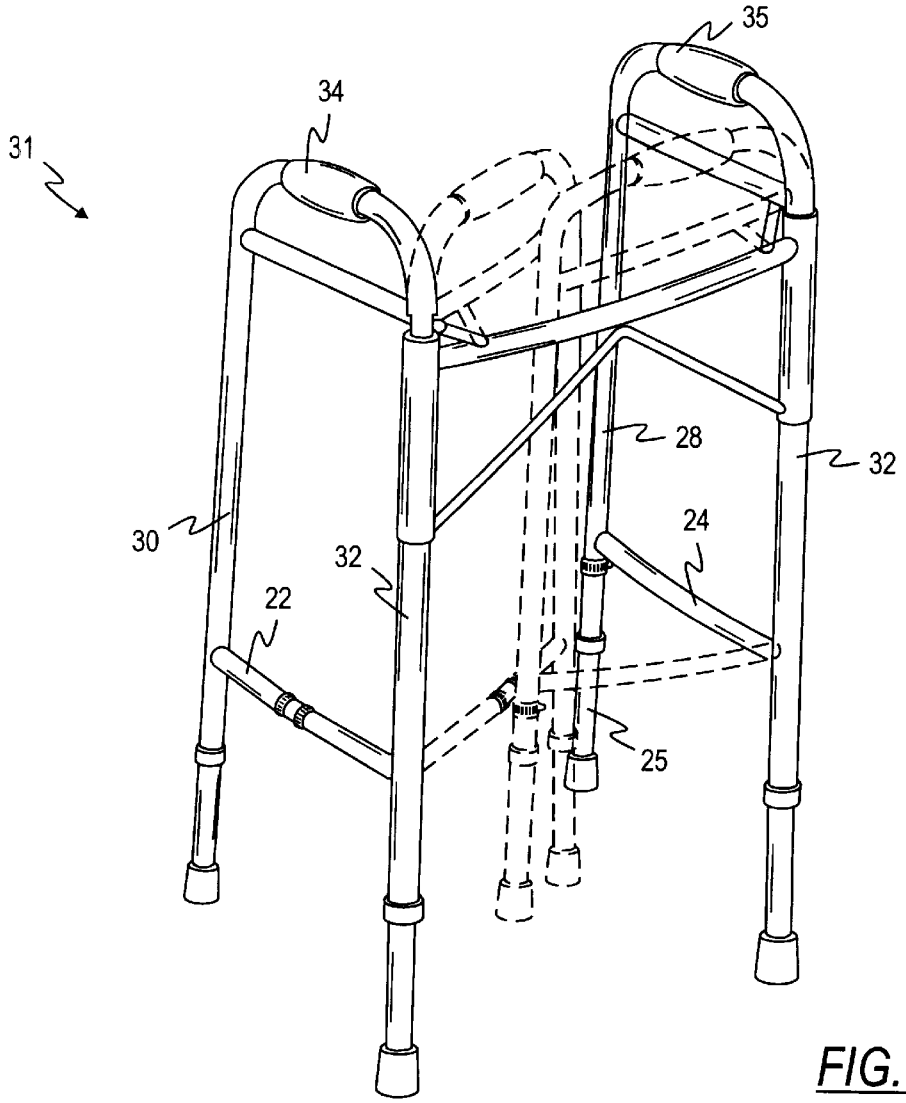
FIG. 1 is a perspective view of a walker with a stabilizer according to principles of the present invention.
Figure 2:
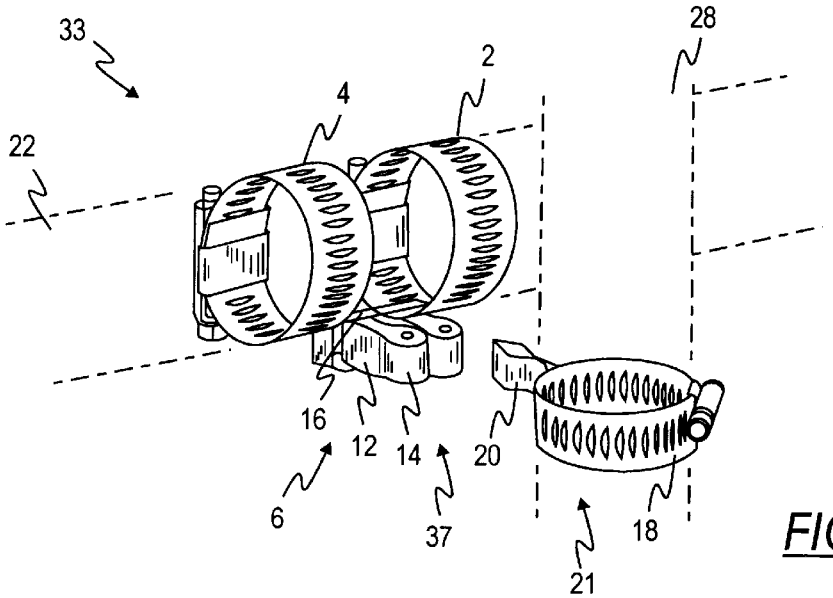
FIG. 2 is a perspective view of the stabilizer according to principles of the present invention.

Referring first to FIGS. 1 and 2, a walker 31 comprising two front legs 32, a right rear leg 30, a left rear leg 28, has a stabilizer 37 attached. The stabilizer 37 comprises a receiving component 33 which is attached to a right lower horizontal bar 22 and a locking member component 21 which is attached to the left rear leg 28 of the walker 31.

Specifically, the receiving component 33 is attached to the right lower horizontal bar by opening two hose clamps 2 and 4 and enclosing them around the right lower horizontal bar 22. Two outstretched arms 12 face inward and are parallel to the ground. The two hose clamps 2 and 4 are tightened so that the receiving component 33 is secured at the appropriate location on the right lower horizontal bar 22 as shown in FIG. 1 and FIG. 2.

The locking member component 21 is placed onto the left rear leg 28 below the left lower horizontal bar 24 and above a telescopic leg piece 26. The locking member component 21, which comprises a protruding member 20 and a hose clamp 18, is attached by opening the hose clamp 18 and enclosing it around the left rear leg 28. The hose clamp 18 is tightened so that the locking member component 21 is secured at the appropriate location on the left rear leg 28 as shown in FIG. 1 and FIG. 2.

To attach the stabilizer 37 onto a standard walker, the walker is folded completely and placed on an ascending step of a staircase. The placement is such that the two front legs 32 of the walker are in contact with the vertical surface of the next ascending step of the staircase. The placement of the handrail of the staircase determines which rear leg of the walker should be unfolded by the user. If the handrail is on the right side of the staircase as viewed by the user when ascending the steps, then the right rear leg 30 of the walker is unfolded to a distance shorter than the width of the step. The walker stands independently and is supported by the two front legs 32 and the right rear leg 30 which provide a triangular base of support. The left rear leg 28 of the walker is unfolded until it comes into contact with the right lower horizontal bar 22. This horizontal bar 22 connects the right front 32 and rear 30 legs of the walker. At this point of contact, the receiving component 33 is to be placed on the right lower horizontal bar 22 and the locking member component 21 is to be placed on the left rear leg 28 such that a locking mechanism is established between the roller clamp 6 and the protruding member 20 of the locking member component 21.

If the handrail is on the left side of the staircase as viewed by the user when ascending stairs, then the above procedure is reversed. Thus, the receiving component 33 is fitted onto the left lower horizontal bar 24 and the locking member component 21 is fitted onto the right rear leg 30.

To ascend a staircase with a right-sided handrail, the stabilizer 37 is attached to the walker as described above. The invalid faces the ascending stairway. The walker, placed in front of the invalid, is folded so that the protruding member 20 of the locking member component 21 on the left rear leg 28 is locked into the roller clamp 6 on the right lower horizontal bar 22 creating a triangular base of support. In this position, the walker is rotated one hundred-eighty degrees counterclockwise and placed on the invalid's left side. The position of the walker is such that the right leg 30 is facing forward, toward the staircase, and the two front legs 32 are in back, facing away from the staircase. The invalid's left hand is placed on the walker's inner handgrip 35. The invalid's right hand is placed on the right sided handrail of the staircase. The walker, with its triangular base of support, is lifted onto each step of the staircase with the invalid's left hand. This will provide stability as the invalid ascends the staircase holding onto the right handrail of the staircase.

The invalid descends a staircase as follows. The invalid faces the staircase with the handrail on the invalid's left side. The walker, with its triangular base of support, is positioned with the two front legs 32 facing forward and the right rear leg 30 facing back. The walker is placed on the invalid's right side. The invalid's right hand is placed on the walker's inner handgrip 35. The invalid's left hand is placed on the left-sided handrail of the staircase. The walker, with its triangular base of support, is lowered onto each step of the staircase with the invalid's right hand. This provides stability as the invalid descends the staircase holding onto the left handrail.

After ascending or descending a staircase, the walker is placed in front of the invalid. The walker is positioned with the two front legs 32 facing forward and the two rear legs 28 and 30 closest to the invalid. Both the left handgrip 34 and the right handgrip 35 located on the top side of the walker are grasped. The invalid provides an outward force on each handgrip to separate the left rear leg 28 from the right lower horizontal bar 22. This outward force will pull the protruding member 20 of the locking member component 21 out of the roller clamp 6, thus, unlocking the stabilizer 37. The walker is opened to its original four-legged position for ambulation on level surfaces.

If the handrail of the staircase is on the left side as viewed by the invalid when ascending the staircase, then the above instructions are reversed. Thus, the invalid ascends the staircase with the walker on the right side of the staircase and descends the staircase with the walker on the left side of the staircase.

Figure 5:
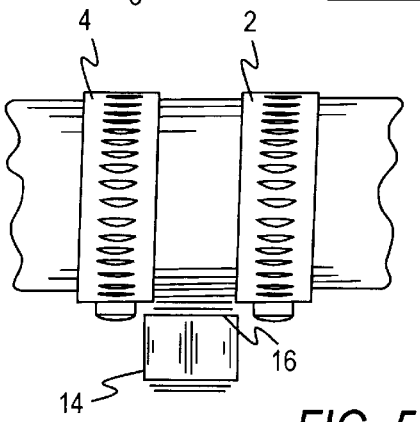
FIG. 5 is a side view of the receiving component of the stabilizer in the closed position according to principles of the present invention.
Figure 6:
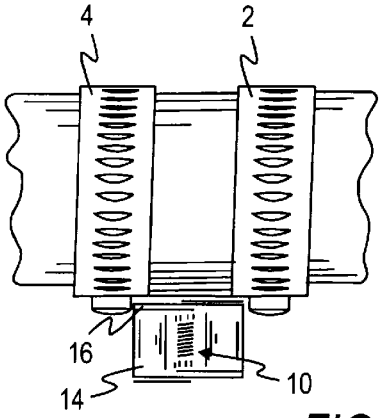
FIG. 6 is side view of the receiving component of the stabilizer in the open position according to principles of the present invention.

FIG. 5 and FIG. 6 illustrate the receiving component 33 of the stabilizer 37 which comprises two hose clamps 2 and 4 positioned on each side of the roller clamp 6. The roller clamp 6 consists of a steel box 8 containing one coiled spring 10. This coiled spring 10 provides tension for the closure of two outstretched arms 12 with plastic rollers 14 on each end. There is a flat strip of steel 16 on one side of the steel box 8 which extends outward to each hose clamp 2 and 4. This flat strip of steel 16 is welded to the inside of each hose clamp 2 and 4 in a predetermined position. The position of the roller clamp 6 after welding is between the two hose clamps 2 and 4 and outside their extended cylindrical area. This configuration allows space for the horizontal bar of the walker to fit within each hose clamp 2 and 4.

Figure 3:
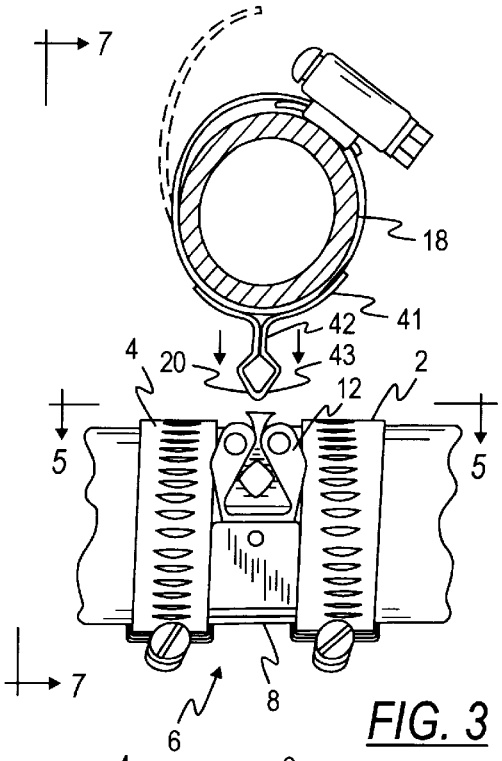
FIG. 3 is a bottom view of the stabilizer in both the attached and the unattached positions according to principles of the present invention.
Figure 4:
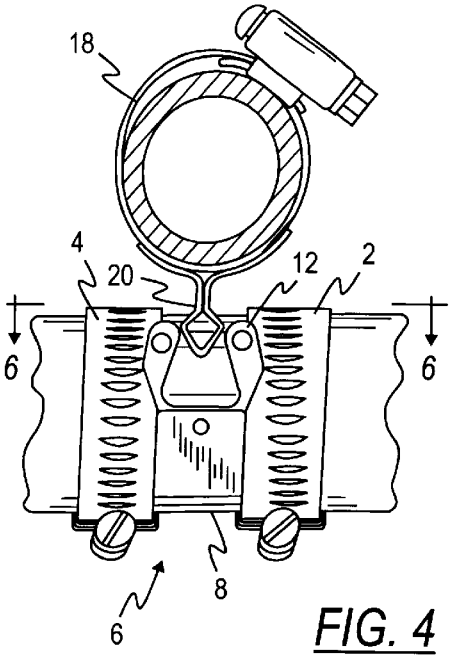
FIG. 4 is a bottom view of the stabilizer in the inserting position according to principles of the present invention.
Figure 7:
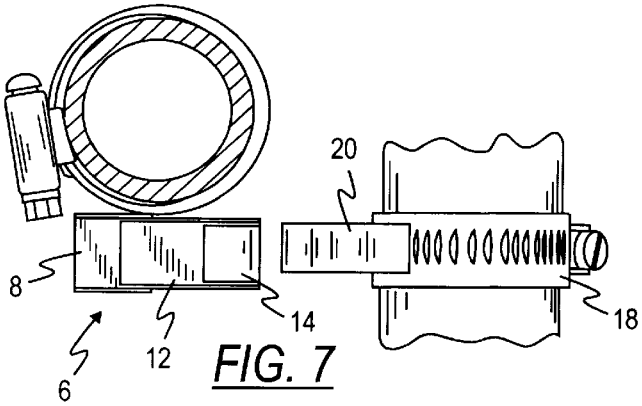
FIG. 7 is a side view of the stabilizer according to principles of the present invention.

Now referring to FIG. 3, FIG. 4, and FIG. 7, the locking member component 21 of the stabilizer comprises a hose clamp 18 and a protruding member 20. The protruding member 20 is made up of one piece of steel configured into an arrow shape as shown in FIG. 3 and FIG. 4 and consists of outstretched arms 41, a neck 42, and a diamond-shaped head 43. The outstretched arms 41 are each welded along the outside of the hose clamp 18 at a predetermined position. The neck 42 must be long enough to fit between the rollers 14, and the diamond-shaped head 43 must fit within the arms 12 of roller clamp 6 when the clamp is in the closed position.

Many variations in the design and composition of the stabilizer are possible. For example, the two stabilizer components can be constructed of materials other than steel in order to reduce cost or to reduce the overall weight of the device. Also, the hose clamps can be replaced by snap-on/screw-on clamps which eliminate the need for a screwdriver and allow easy on-and-off attachment of the stabilizer. Furthermore, the protruding member 20 can be configured into other shapes such as circular, oval, square, or triangular configurations, which provide unique locking mechanisms.

Also, the two components of the stabilizer can be constructed in varying sizes. An increase in size of the stabilizer allows the user more visible access when locking and unlocking the device and provides less chance of accidental separation of the components. A decrease in size of the stabilizer would provide a more cosmetic appearance.

Additionally, the two components of the stabilizer can have varying colors to provide the user with a more visible appearance and assist in distinguishing the device from its surroundings. Also, the rollers on the roller clamp component can be contained within a protective box covering the top, sides, and bottom. This box would provide protection and assist in supporting the device when locked.

The two hose clamps on the roller clamp component can be replaced by clamps which allow this piece to slide along the horizontal bar. This would allow the roller clamp component to be secured at any point along the horizontal bar without being removed. Thus, the triangular base of support can be easily altered to fit steps of varying widths.

Figure 8:
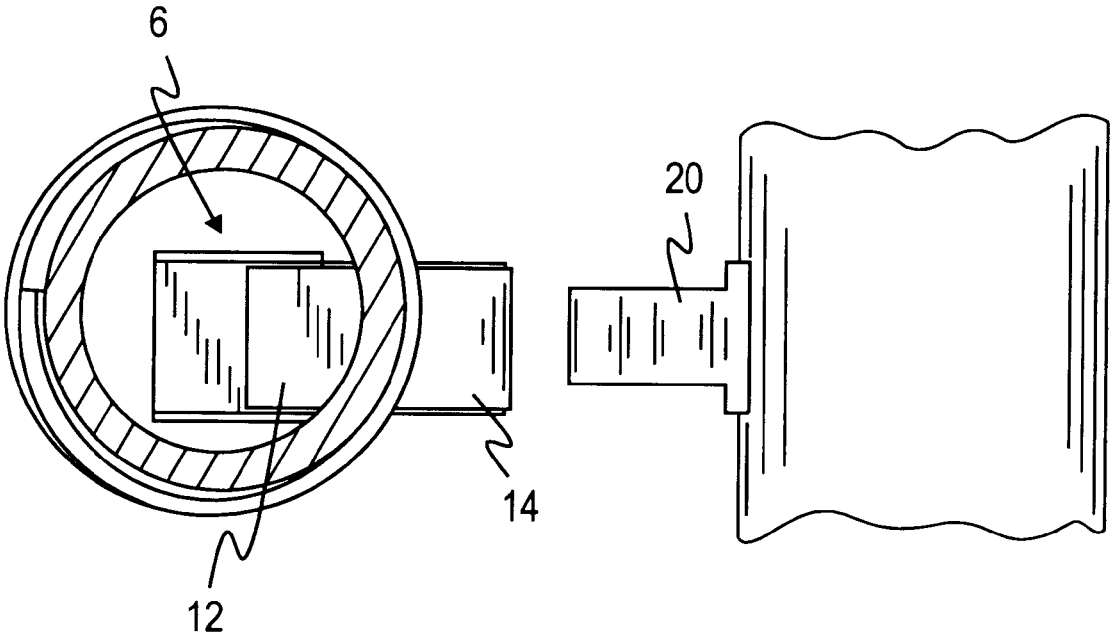
FIG. 8 is a side view of the stabilizer with integral receiving and locking member components according to principles of the present invention.

Moreover, the two stabilizer components can be molded into the walker during the construction of the walker in order to eliminate any excessive attachments as shown in FIG. 8. Finally, the hose clamps on each side of the roller clamp can each have a steel piece attachment. These pieces would prevent excessive opening of the roller clamp's outstretched arms and prevent unwanted unlocking of the stabilizer.

Thus, a stabilizer for a walker is provided allowing safe and assistance-free ascending and descending of stairs by invalids. The stabilizer does not interfere with the operation of the walker when the stabilizer is not in use due to the small size and placement of its components. The stabilizer requires only a few, simple steps to attach and use, eliminating the need for a set of detailed instructions. The components of the stabilizer are simple to manufacture and cost-effective to produce because of the simplicity of the stabilizer design and low-cost of materials used for construction of the stabilizer components. Finally, the stabilizer is adaptable for use with various types of walkers because the stabilizer components easily fit onto walkers of varying sizes and manufacturers.

Figure 9:
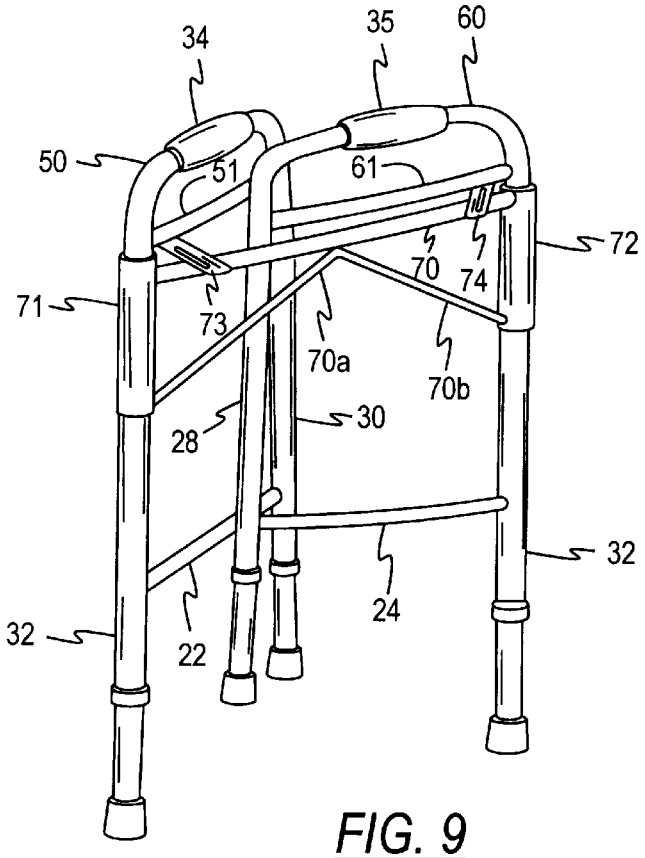
FIG. 9 is a perspective view of a modified folding walker embodying the present invention folded to its intermediate latched position, between its open and collapsed position.
Figure 10:
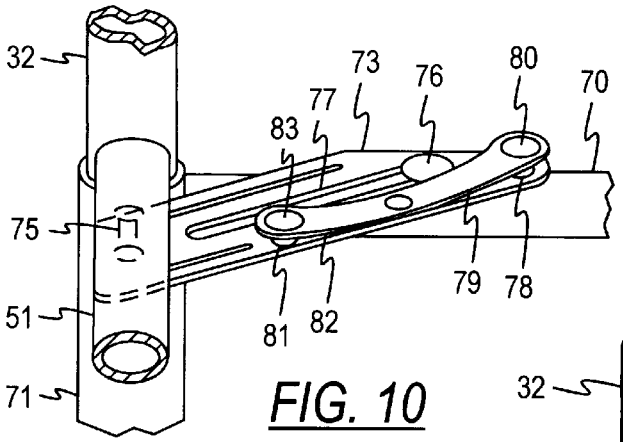
FIG. 10 is an enlarged perspective view of the latching mechanism in the walker of FIG. 9 with the walker in its open condition.
Figure 11:
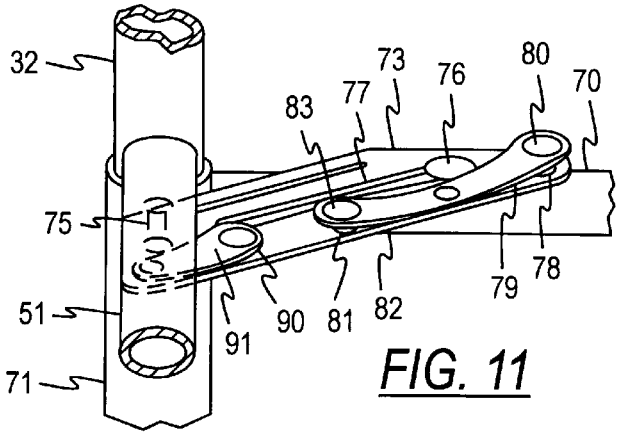
FIG. 11 is an enlarged perspective view of a modified latching mechanism for use in the walker of FIG. 9.

A modified embodiment of the invention is illustrated in FIGS. 9–11, which illustrate a folding walker having a latching mechanism for locking the side frames of the walker in a selected one of two or more different non-collapsed positions. Elements which are common to the descriptions of the embodiments of FIGS. 1–8 and 9–11 are identified by the same reference numerals. The right side frame includes an inverted U-shaped metal tubing which forms the right rear leg 30 and one of the two front legs 32. As mentioned previously, all the legs of the walker have telescoping sections at the lower ends thereof. The transverse section of the inverted U-shaped tubing forms the uppermost cross member 50 that receives the handgrip 34 for the right side frame. The side frame is completed by the lower horizontal bar 22 and a parallel upper horizontal bar 51, both of which extend between and are connected to the legs 30 and 32. The structure of the left side frame is similar, including an inverted U-shaped metal tubing which forms an uppermost cross member 60 carrying the handgrip 35, the lower horizontal bar 24 and an upper horizontal bar 61.

The two side frames are connected by a lateral cross bar 70 which is pivotally connected at opposite ends to the two front legs 32 of the side frames. The pivotal connections include a pair of sleeves 71 and 72 which surround upper portions of the front legs 32 to allow pivoting movement of the two side frames within the sleeves 71 and 72. The cross bar 70 and sleeves 71 and 72 are reinforced by a pair of struts 70*a* and 70*b*.

The cross bar 70 and the sleeves 71 and 72 are held in the desired vertical position by a pair of latch plates 73 and 74 each of which is pivotally connected at one end to one of the upper horizontal bars 51 and 61, respectively by pins 75. One of the pins 75 is shown most clearly in FIG. 10. The latch plates 73 and 74 are also attached to the cross bar 70 by a pin 76 which projects upwardly from the cross bar 70 and is captured within elongated slots 77 formed in the latch plates. As can be clearly seen in FIG. 10, the heads of the pins 76 are wider than the slots 77 to ensure that the pins 76 cannot escape from the latch plates. It can be seen that the manner in which the latch plates 73 and 74 are connected to the cross bar 70 and the horizontal bars 51 and 61 permits the side frames to be pivoted around the axes of the front legs 32. Consequently, both side frames can be pivoted between a fully open position in which the side frames are substantially perpendicular to the cross bar 70, and a fully collapsed position in which the two side frames and the cross member 70 are all substantially parallel to each other, or at least closely nested together.

Folding walkers are conventionally made with two spring-loaded latching pins mounted within the front cross bar 70. When the side frames of the walker are pivoted to their fully open positions, i.e., substantially perpendicular to the cross bar 70, the latching pins in the cross bar 70 register with a pair of holes 78, one in each of the latch plates 73 and 74. The spring load on the latching pins causes the pins to move upwardly into the holes in the latch plates and snap into place. The latching engagement of the pins within the holes of the latch plates maintains the side frames in the open position until the latching pins are depressed to release them from the plates. For this purpose, a flexible and resilient release arm 79 is mounted on each latch plate. This release arm 79 carries a short pin 80 that is in register with the latching hole 78 in the plate to facilitate depression of the spring-loaded latching pin when it is desired to unlatch the walker so that the side frames can be pivoted to their collapsed positions. The user simply presses down on the end of the release arm 79 and holds it down while pivoting the corresponding side frame so that the hole 78 in the corresponding latch plate is no longer in register with the latching pin.

To permit the side frames to be latched in an intermediate position between the fully open position and the collapsed position, each latch plate 73 and 74 is provided with a second latching hole 81 and a second release arm 82. When the side frames are pivoted to the intermediate position, as illustrated in FIG. 9, the standard spring-loaded latching pins in the cross bar 70 snap into the intermediate-position latching holes 81 in the two latch plates to lock the side frames in that intermediate position.

As explained previously, the walker has a generally triangular configuration when latched in this intermediate position, to facilitate use of the walker on stairs. The second release arm 82 carries a short pin 83 registered with the intermediate latching hole 81 so that manual depression of the arm 82 causes the pin 83 to depress the corresponding spring-loaded latching pin and thereby release the side frame for pivoting movement to either the collapsed position or the fully open position.

FIG. 11 illustrates a modified latching arrangement which provides two different intermediate latch positions for the side frames of the walker. This is achieved by providing a third hole 90 in each of the latching plates 73 and 74, and a third release arm 91 carrying a pin registered with the third hole. Thus, when the side frames are pivoted to positions that bring the spring-loaded latching pins into register with the third holes of the latching plates, the latching pins snap into the latching holes to lock the side frames in this position until the pins are released by depressing the release arm 91.

To hold the side frames in different positions, a pair of latching mechanisms are provided at the two top corners of the walker where the side frames are pivotally connected to the cross bar on the front of the walker. Each latching mechanism includes a spring-biased latching pin captured within the hollow interior of the front cross bar, with the upper end of the pin being exposed through a hole in the top surface of the cross bar. The biasing spring urges the pin upwardly so that the top end of the pin extends through the hole in the cross bar, but a lateral projection on the pin prevents it from escaping from the cross bar by engaging the inside surface of the cross bar to limit the upward travel of the pin as it is urged upwardly by the biasing spring.

While the present invention has been described with reference to certain preferred embodiments, those skilled in the art will recognize that many changes may be made thereto without departing from the spirit and scope of the present invention which is set forth in the following claims.

I claim:

1. A stabilizer for attachment to a walker, said walker having first and second moveable leg sections, said stabilizer comprising:

a locking member component coupled to said first leg section on said walker, said locking member component having a protruding member; and a receiving component comprising first and second hose clamps coupled to said second leg section on said walker, said receiving component having a locking mechanism for receiving and holding said protruding member in place, said locking mechanism comprises a roller clamp attached between said first and second hose clamps.

2. The stabilizer of claim 1 wherein said roller clamp comprises two rollers and a spring for providing tension between said two rollers.

3. A stabilizer for attachment to a walker, said walker having first and second moveable leg sections, said stabilizer comprising:

first clamping means for attachment to said first leg section on said walker;

a protruding member coupled to said first clamping means;

second clamping means comprising a pair of hose clamps for attachment to said second leg on said walker; and locking means coupled to said second clamping means, said locking means for receiving and holding said protruding member in place, said locking means comprises a roller clamp secured between said pair of hose clamps.

4. A stabilizer for attachment to a walker, said walker having first and second moveable leg sections, said stabilizer comprising:

a first hose clamp, said hose clamp attached to said first leg section on said walker;

an arrow-shaped protruding member coupled to said first hose clamp, said arrow-shaped protruding member formed of steel having a narrow stem section and pointed end section;

second and third hose clamps, said second and third hose clamps attached to said second leg section on said walker; and a roller clamp, coupled between said second and third hose clamps, said roller clamp for receiving and holding said arrow-shaped protruding member in place, said roller clamp comprised of a two rollers and a coiled spring for providing tension between said rollers.

5. A stabilized walker, said walker comprising:

first and second leg sections;

a front brace joining said first and second leg sections, said leg sections attached and pivotal about said front brace;

a leg brace coupled across said first leg section;

a locking member component attached to said first leg section on said walker, said locking member component having a protruding member; and a receiving component attached to said second leg section on said walker, said receiving component having a locking mechanism for receiving and holding said protruding member in place, said first leg section, said second leg section, and said front brace forming a triangular profile when said protruding member is received and held in place by said locking mechanism, wherein said locking member component comprises a hose clamp.

6. The stabilizer of claim 5 wherein said hose clamp component comprises first and second hose clamps.

7. The stabilizer of claim 5 wherein said locking mechanism comprises a roller clamp, said roller clamp attached between said first and second hose clamps.

8. A stabilized walker comprising:

first and second leg sections;

a front brace joining said first and second leg sections, said leg sections attached to and pivotal about said front brace;

a leg brace coupled across said first leg section;

a locking member component for attachment to said first leg section on said walker, said locking member component comprised of a first hose clamp having a protruding member coupled thereto, said protruding member arrow-shaped and formed from a single steel section; and a receiving component for attachment to said second leg section on said walker, said receiving component comprised of second and third hose clamps, said receiving component having a locking mechanism coupled to said second and third hose clamps, said locking mechanism comprising a roller clamp, said roller clamp for receiving and holding said arrow-shaped protruding member in place, said roller clamp comprised of first and second rollers and a coiled spring for providing tension between said rollers, said roller clamp attached between said second and third hose clamps, said first leg section, said second leg section, and said front brace forming a triangular profile when said protruding member is received and held in place by said locking mechanism.

9. A folding walker for assisting a person in remaining upright while walking, said walker comprising a first side frame including front and rear legs spaced from each other and held together by upper and lower connecting members, a second side frame including front and rear legs spaced from each other and held together by upper and lower connecting members, at least one lateral cross bar connecting the front legs of said first and second side frames, the connections between said cross bar and said side frames being pivotable to permit said side frames to be pivoted from open positions in which said side frames are substantially perpendicular to said lateral brace and collapsed positions in which said side frames are substantially parallel to said cross bar, first latching means for holding said side frames in said open positions, and second latching means for holding said side frames in an intermediate position, between said open and collapsed positions, in which said side frames are at an acute angle to said cross bar so that said side frames and said cross bar form a generally triangular configuration to facilitate use of the walker on stairs.

10. The folding walker of claim 9 wherein said latching means includes a pair of latch plates each of which is attached to one of said side frames and both of which are slidably connected to said cross bar, a pair of latching pins mounted within said cross bar and spring biased upwardly to project through a pair of holes in said cross bar, each of said latch plates forming at least one latching hole for receiving one of the upwardly projecting pins and thereby latching the side frame to said cross bar.

11. The folding walker of claim 10 which further includes release means on each of said latch plates for depressing the pin received in the latching hole of that plate to release the pin from the plate.

12. A method of using a walker for assisting a person to remain upright while walking, said method comprising providing a folding walker having a first side frame including front and rear legs spaced from each other and held together by upper and lower braces; a second side frame including front and rear legs spaced from each other and held together by upper and lower braces; at least one lateral brace connecting the front legs of said first and second side frames to hold said front legs substantially parallel to each other, the connections between said lateral brace and said side frames being pivotable to permit said side frames to be pivoted from open positions in which said side frames are substantially to said lateral brace and collapsed positions in which said side frames are substantially parallel to said lateral brace; first latching means for holding said side frames in said open positions, and second latching means for holding said side frames in an intermediate position, between said open and collapsed positions, in which said side frames are at an acute angle to said lateral brace so that said side frames and said lateral brace form a generally triangular configuration to facilitate use of the walker on stairs;

unlatching said second latching means and latching said first latching means before using said walker on substantially flat surfaces; and unlatching said first latching means and latching said second latching means before using said walker on stairs.

13. The method of claim 12 wherein said latching means includes a pair of latch plates each of which is attached to one of said side frames and both of which are slidably connected to said cross bar, a pair of latching pins mounted within said cross bar and spring biased upwardly to project through a pair of holes in said cross bar, each of said latch plates forming at least one latching hole for receiving one of the upwardly projecting pins and thereby latching the side frame to said cross bar.

14. The method of claim 13 wherein said latching means further includes release means on each of said latch plates for depressing the pin received in the latching hole of that plate to release the pin from the plate.

* * * * *